US006814924B2

(12) United States Patent
Urabe et al.

(10) Patent No.: US 6,814,924 B2
(45) Date of Patent: Nov. 9, 2004

(54) ROTARY HEARTH FURNACE AND SCREW THEREOF FOR DISCHARGING REDUCED IRON

(75) Inventors: Yoshihiro Urabe, Osaka (JP); Sumito Hashimoto, Osaka (JP); Takao Umeki, Osaka (JP)

(73) Assignee: Kobe Steel, Ltd., Kobe (JP)

( * ) Notice: Subject to any disclaimer, the term of this patent is extended or adjusted under 35 U.S.C. 154(b) by 19 days.

(21) Appl. No.: 10/448,207

(22) Filed: May 30, 2003

(65) Prior Publication Data

US 2003/0201585 A1 Oct. 30, 2003

Related U.S. Application Data

(63) Continuation of application No. 09/982,781, filed on Oct. 22, 2001, now Pat. No. 6,660,221.

(51) Int. Cl.[7] ..... C21B 13/10
(52) U.S. Cl. ..... 266/177; 266/195; 75/484
(58) Field of Search ..... 266/177, 195; 75/484

(56) References Cited

U.S. PATENT DOCUMENTS

| | | | |
|---|---|---|---|
| 3,443,931 | A | 5/1969 | Beggs et al. |
| 4,636,127 | A | 1/1987 | Olano et al. |
| 5,863,197 | A | 1/1999 | Boy et al. |
| 5,885,521 | A | 3/1999 | Meissner et al. |
| 5,924,861 | A | 7/1999 | Rinker et al. |
| 6,015,527 | A | 1/2000 | Kamei et al. |
| 6,126,718 | A | 10/2000 | Sawa et al. |
| 6,152,729 | A | 11/2000 | Rinker et al. |
| 6,182,817 | B1 | 2/2001 | Rinker et al. |
| 6,660,221 | B2 * | 12/2003 | Urabe et al. ..... 266/177 |

FOREIGN PATENT DOCUMENTS

| | | |
|---|---|---|
| GB | 372 965 | 5/1932 |
| JP | 3020482 | 3/2000 |
| WO | WO 00/29628 | 5/2000 |

OTHER PUBLICATIONS

Patent Abstracts of Japan, JP–2001–064170, Mar. 13, 2001.

* cited by examiner

*Primary Examiner*—Scott Kastler
(74) *Attorney, Agent, or Firm*—Oblon, Spivak, McClelland, Maier & Neustadt, P.C.

(57) ABSTRACT

A rotary hearth furnace is provided to simplify detachment and assembly operations of a reduced iron discharging screw.

At both side walls of an insulating housing 2*a* constituting in part of a furnace body 2 of a rotary hearth furnace 1 are installed through-holes which a spiral blade 42 of a reduced iron discharging screw 4 can pass through, each of the through-holes is closed by an inner hatch member 8 and an outer hatch member 9 which are externally mounted in a removable fashion to a rotary shaft 41 of the reduced iron discharging screw 4, an inner screw supporting device 10 is installed in the outside at an inner periphery side of the hearth 3 as well as an outer screw supporting device 20 is installed in the outside at an outer periphery side of the hearth 3. The reduced iron discharging screw 4 is detached from the furnace body 2 via the through-holes and assembled to the furnace body 2 via the through-holes by using the inner screw supporting device 10 and the outer screw supporting device 20.

1 Claim, 4 Drawing Sheets

ROTARY HEARTH FURNACE AND SCREW THEREOF FOR DISCHARGING REDUCED IRON

This application is a continuation of U.S. application Ser. No. 09/982,781, filed on Oct. 22, 2001, and now U.S. Pat. No. 6,660,221.

BACKGROUND OF THE INVENTION

1. Field of the Invention

The present invention relates to a rotary hearth furnace for manufacturing reduced iron through reduction of a raw material for reduced iron mainly composed of carbonaceous reducing material and iron oxide, and a screw thereof for discharging reduced iron on a hearth out of the rotary hearth furnace from an discharge port.

2. Description of the Related Art

As well known in the art, a rotary hearth furnace is used for manufacturing reduced iron through reduction of a raw material for reduced iron mainly composed of carbonaceous reducing material and iron oxide.

Such a rotary hearth furnace has a screw for discharging reduced iron on a hearth out of the rotary hearth surface from an discharge port installed at an outer periphery side, that is, at a high-speed side on the furnace rotating about a vertical shaft. The durability of the reduced iron discharging screw is essential in enhancing the operation rate of the rotary hearth furnace or the productivity of reduced iron so that various means have been proposed up to now to enhance the durability of the reduced iron discharging screw.

According to an example of the reduced iron discharging screw, a cooling water channel is installed within a screw shaft or a rotary shaft, in which cooling water flowing through the cooling water channel lowers temperature to ensure the strength of the screw shaft, and a hollow portion is provided in a screw blade or a spiral blade, in which cooling water flowing through the hollow portion lowers temperature to ensure the hardness of the screw blade so that the wear resistance of the screw blade can be improved.

Further, according to another example of the reduced iron discharging screw, a cooling water channel is installed within a screw shaft or a rotary shaft of the reduced iron discharging screw, in which cooling water flowing through the cooling water channel lowers temperature to ensure the strength of the screw shaft thereby improving the durability of the screw shaft while two screw blades or spiral blades are joined together at a portion subjected to especially heavy abrasion to prolong the lifetime of the screw blades. Also, in order to further enhance the wear resistance of leading ends of the screw blades, an Inconel alloy (nickel 55% and chromium 45%) is built up via welding at both sides of the leading ends of the screw blades.

However, even if the strength of the screw shaft of the reduced iron discharging screw is enhanced and the screw blade has prolonged lifetime through improvement of the wear resistance of the screw blade and increase of wearing region, all kinds of reduced iron discharging screws require maintenance processes to detach the screw from the rotary hearth furnace for repair and to assemble the same to the rotary hearth furnace after repair. Such maintenance processes of the reduced iron discharging screw are carried out after stopping the operation of the rotary hearth furnace and the temperature within the rotary hearth furnace is lowered under a temperature which is suitable for the maintenance processes. In the maintenance processes, the reduced iron discharging screw is separated from a mooring equipment and a coupling, and then detached from the upper part through a furnace body cover of the rotary hearth furnace for repair, and assembled to the rotary hearth furnace from the upper part after repair.

In the reduced iron discharging screw of the prior art, corrosive gas generated from the raw material for reduced iron coheres to the surface of the screw shaft or the surface of the screw blade which is cooled through flowing of cooling water. Therefore, cohered corrosive gas causes cold corrosion to the surface of the screw shaft or the surface of the screw blade thereby decreasing the lifetime thereof. Even in the case iron ores are reduced, sulfur included in coal mixed into staple pellets as a reducing agent generates $SO_x$, which causes corrosion to the surface of the screw shaft or the surface of the screw blade thereby decreasing the lifetime thereof as the raw material for reduced iron.

In addition, in the prior art, the screw shaft using carbon steel has a service life of 4 to 10 months until cooling water leaks, and the screw blade has the lifetime of about 5 months. In other words, it can be hardly considered that any of the screw shaft or the screw blade has a sufficient service life and the maintenance operation of the reduced iron discharging screw should be performed frequently so that the operating ratio of the rotary hearth furnace cannot be enhanced. Further, even if the screw blade is covered with a hard facing layer, which is constituted through hard facing of an Inconel alloy at both sides of the leading end and a leading portion of the screw blade by welding, sides of the screw blade tend to have welding defects such as an undercut between a base metal and a hard facing portion so that the screw blade may be damaged by a notch effect and accordingly the maintenance operation may be necessary even if other portions are sufficiently available.

In the reduced iron discharging screw having two screw blades joined together, the screw blades shaped as spiral blades are joined together at regions subjected to heavy abrasion to increase thickness thereby prolonging the lifetime of the screw blades. However, in this case, it is difficult to manufacture the two screw blades in high precision and the cost of the reduced iron discharging screw is inevitably increased because the screw blades are formed in three-dimensional shape.

Further, in the maintenance operation of the reduced iron discharging screw, since the cover of the furnace body should be detached at least as wide as the projected area of the reduced iron discharging screw and the cover of the furnace body is large, a radiation scheme is required in a large scale. Also, in regard to layout of the equipments, the equipments such as staple pins are frequently arranged at the upper position of the reduced iron discharging screw so that there is a problem that time and endeavor are required in a great amount to detach the reduced iron discharging screw according to arrangement among the equipments.

SUMMARY OF THE INVENTION

Accordingly, it is an object of the invention to provide a rotary hearth furnace for enabling a reduced iron discharging screw to be easily detached and assembled, and a reduced iron discharging screw of a rotary hearth furnace excellent in durability.

The present invention has been accomplished in view of the aforementioned circumstances, and according to claim 1 to solve the foregoing objects, it is provided a rotary hearth furnace including a reduced iron discharging screw, which is rotationally supported via an axial end of a rotary shaft by a pair of supporting devices with the axial end of said rotary shaft passing through-holes formed in both side walls at one and the other sides of a furnace body and has a spiral blade at the outer periphery side of said rotary shaft for discharging reduced iron on a hearth out of the furnace body, from an discharge port formed at an outer periphery side of the rotating hearth, wherein the through holes in said both side walls are set in a size for allowing the spiral blade of the reduced iron discharging screw to pass the same, and closed by a hatch member externally mounted to the axial end of said rotary shaft in a removable fashion; wherein the inner screw supporting device including a screw supporting metal member capable of reciprocating with a leading end detachably connected to the axial end of said rotary shaft, and a metal member dragging means for dragging the screw supporting metal member out of the furnace body is provided in the outside at an inner periphery side of said hearth; and wherein the outer screw supporting device including screw dragging means for removing said reduced iron discharging screw out of the furnace body, and a screw supporting bogie capable of reciprocating for supporting the removed reduced iron discharging screw is provided in the outside at an outer periphery side of said hearth.

According to a $2^{nd}$ aspect of the invention to solve the foregoing objects, it is provided a reduced iron discharging screw of a rotary hearth furnace for discharging reduced iron on a hearth out of a furnace body from an discharge port formed at an outer periphery side, which has a spiral blade at the outer periphery of a rotary shaft with the inside being cooled through flowing of cooling water; wherein a refractory layer is formed at the outer periphery of said rotary shaft.

According to a $3^{rd}$ aspect of the invention to solve the foregoing objects, it is provided a reduced iron discharging screw according to the $2^{nd}$ aspect of the invention, which further comprises an elongated groove thinner than the thickness width of the spiral blade at the leading end of said spiral blade, wherein the elongated groove is filled with a hard facing layer.

According to a $4^{th}$ aspect of the invention to solve the foregoing objects, it is provided a reduced iron discharging screw according to the $2^{nd}$ or $3^{rd}$ aspects of the invention, wherein said spiral blade has threads in a greater number at an outer periphery side of the hearth than at an inner periphery side of said hearth.

According to a $5^{th}$ aspect of the invention to solve the foregoing objects, it is provided a reduced iron discharging screw according to any of the $2^{nd}$–$4^{th}$ aspect of the invention, wherein the axial end of said rotary shaft is supported via buffer members to be elevated and maintained at a certain height by a supporting device.

DESCRIPTION OF THE PREFERRED EMBODIMENTS

Figure 1:
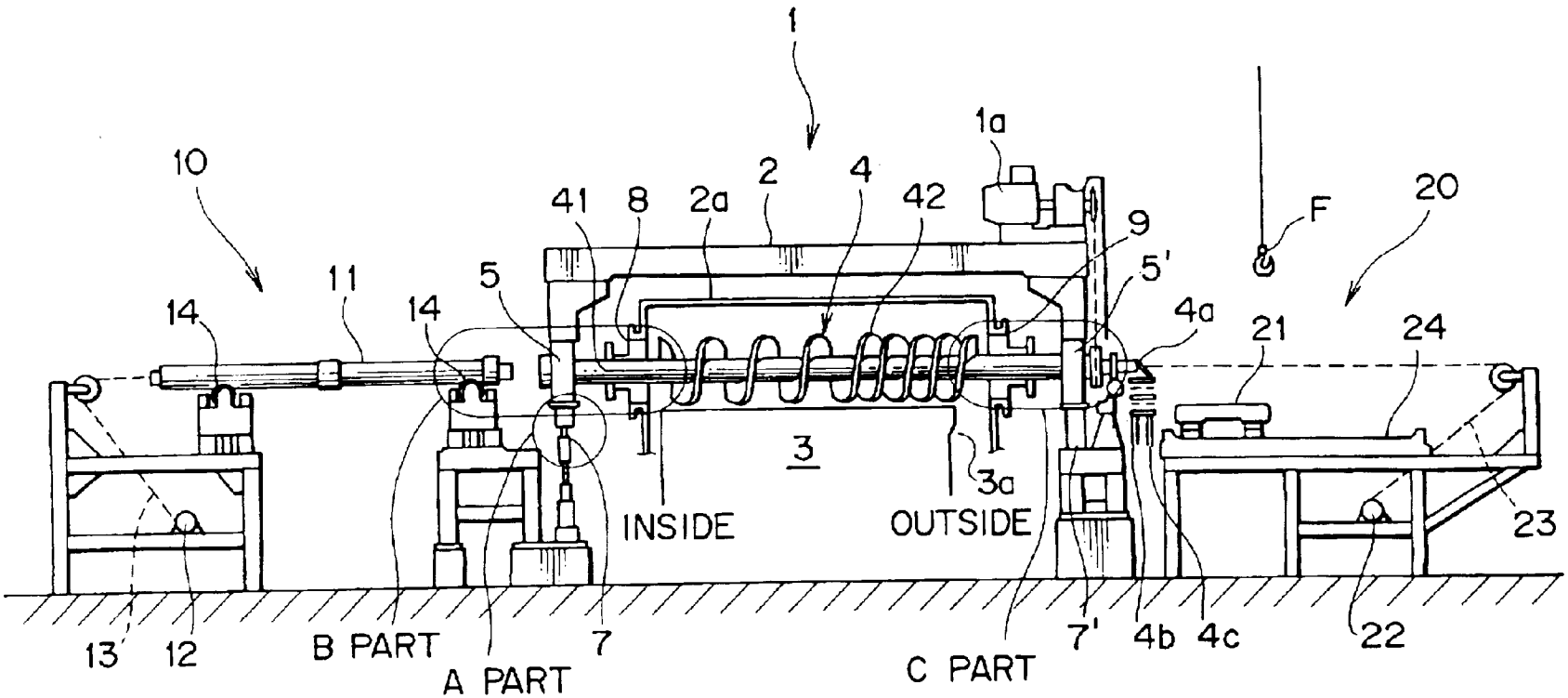
FIG. 1 illustrates a sectional constitution in an arranging position of the reduced iron discharging screw of the rotary hearth furnace according to the embodiment of the invention.
Figure 2:
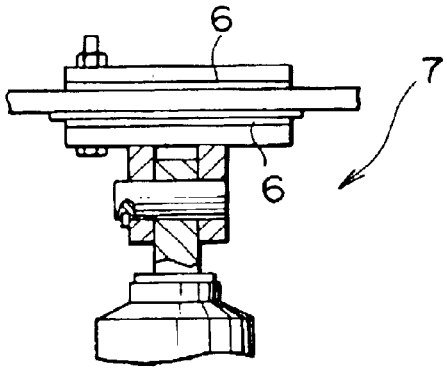
FIG. 2 is a detailed view of a part A shown in FIG. 1.
Figure 3:
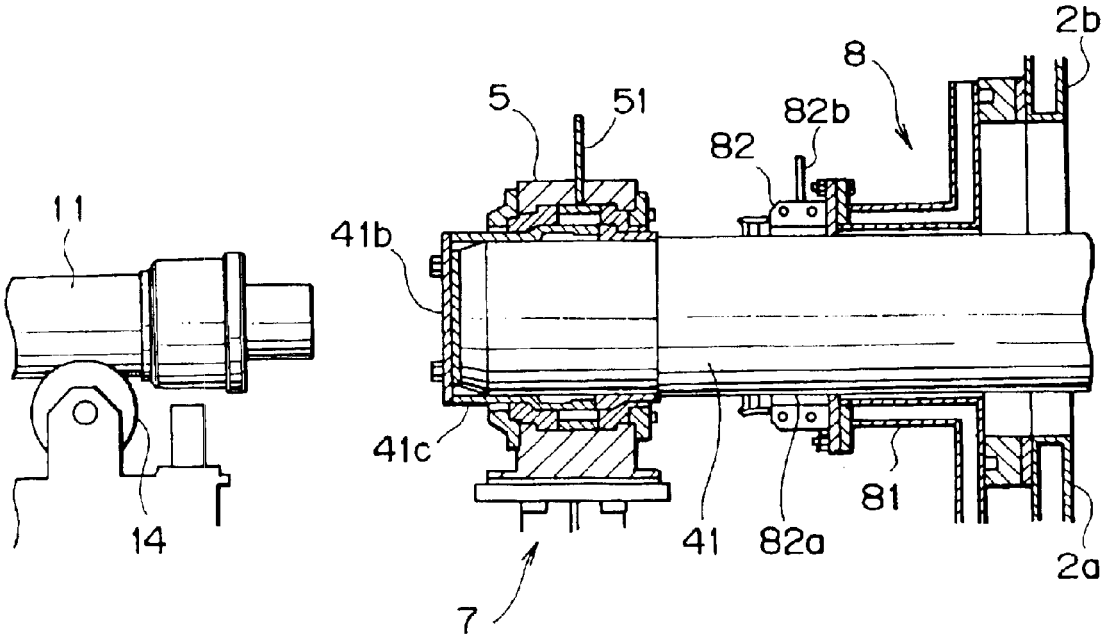
FIG. 3 is a detailed view of a part B shown in FIG. 1.
Figure 4:
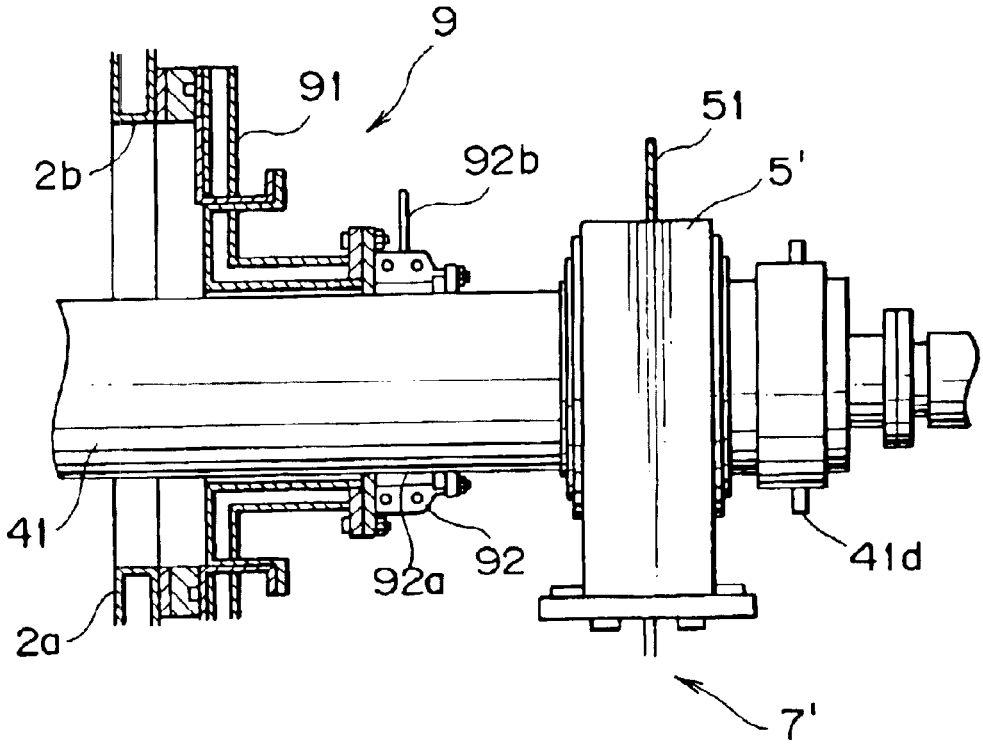
FIG. 4 is a detailed view of a part C shown in FIG. 1.
Figure 5:
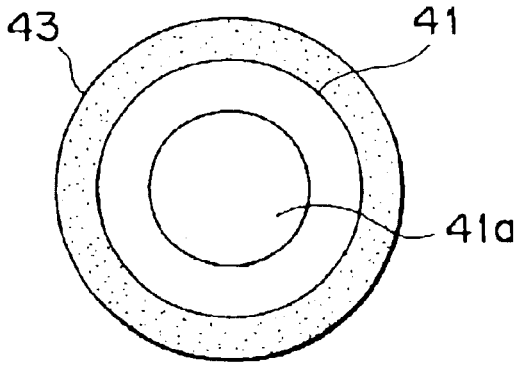
FIG. 5 is a sectional view of a rotary shaft of the reduced iron discharging screw according to the embodiment of the invention.
Figure 6:
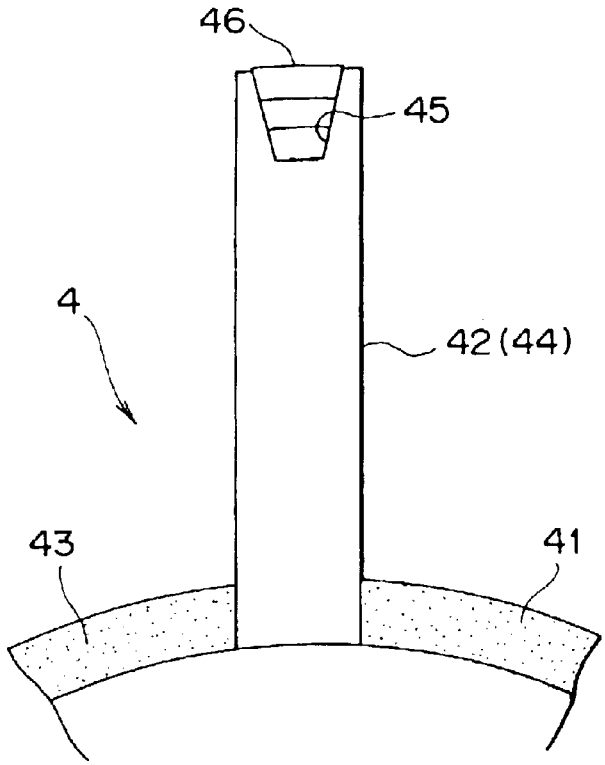
FIG. 6 is a sectional view of a spiral blade according to the embodiment of the invention.
Figure 7:
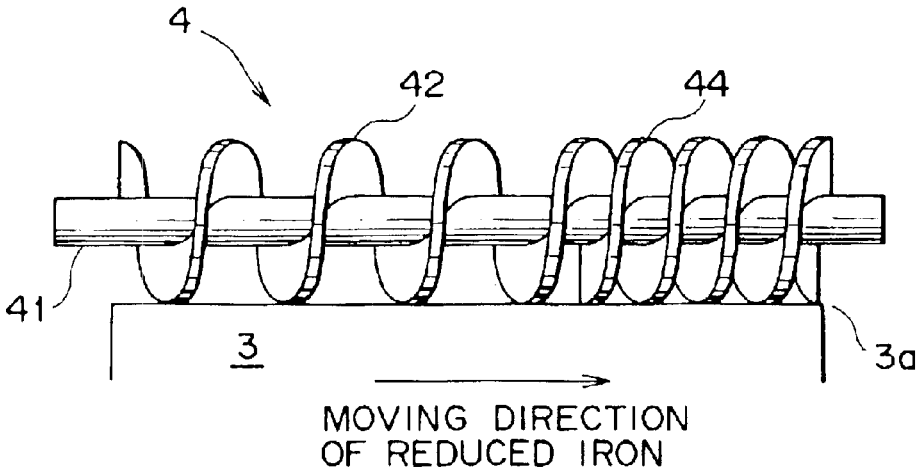
FIG. 7 illustrates a side constitution of the reduced iron discharging screw according to the embodiment of the invention.

Hereinafter, a rotary hearth furnace and a reduced iron discharging screw of the rotary hearth furnace according to a preferred embodiment of the present invention will be described below in reference to the accompanying drawings, in which: FIG. 1 illustrates a sectional constitution in an arranging position of the reduced iron discharging screw of the rotary hearth furnace; FIG. 2 is a detailed view of a part A shown in FIG. 1; FIG. 3 is a detailed view of a part B shown in FIG. 1; FIG. 4 is a detailed view of a part C shown in FIG. 1; FIG. 5 is a sectional view of a rotary shaft of the reduced iron discharging screw; FIG. 6 is a sectional view of a spiral blade; and FIG. 7 illustrates a side constitution of the reduced iron discharging screw.

The reference numeral 1 shown in FIG. 1 designates a rotary hearth furnace which comprises a furnace body 2 having a reduced iron discharging screw 4 configured as follows for discharging reduced iron on a hearth 3 rotating about a vertical rotary center not shown in the left in FIG. 1 to an discharge port 3*a* installed at an outer periphery side in the right of the hearth 3. The reduced iron discharging screw 4 has a rotary shaft 41 with ends, which are installed in both side walls of an insulating housing 2*a* for partially constituting the furnace body 2 which covers the upper part of the hearth 3 and inserted with a play into through-holes 2*b*, which are set in a such dimension that a spiral blade 42 of the reduced iron discharging screw 4 can pass through the same. At an inner periphery side of the hearth 3 of the rotary shaft 41 is externally fitted an inner bearing 5 constituted by connection of a grease feed pipe 51 into the axial end of the rotary shaft 41, and at the outer periphery side is externally fitted an outer bearing 5' constituted by connection of the grease feed pipe 51 into the axial end.

The inner bearing 5, as shown in FIG. 2, is supported via buffer members 6 made of an elastic member such as a rubber sheet on upper and lower surfaces of flanges attached to the inner bearing 5 to be elevated by a hydraulic inside supporting device 7. Also, the outer bearing 5' is supported via buffer members not shown to be elevated by a hydraulic outside supporting device 7'. In this case, the inner and outer supporting devices 7 and 7' are adapted to uniformly maintain the distance between the axial center of the reduced iron discharging screw 4 and the hearth 3, the buffer members 6 are adapted to maintain the contact pressure of a leading end of the spiral blade 42 of the reduced iron discharging screw 4 to the surface of the hearth 3 at or under a certain value because for example, unevenness exists on the surface of the hearth 3 (it is impossible to remove all).

In addition, since the inside and outside supporting devices 7 and 7' are hydraulically operated, they may be configured to displace the reduced iron discharging screw 4 upward when the contact pressure of the leading end of the spiral blade 42 is at or under the certain value. Since the supporting devices 7 and 7' are configured as above, there is an effect that damage of the reduced iron discharging screw 4 or the hearth 3 caused by clogging of foreign materials can be prevented.

Each of the through-holes 2*b*, 2*b* is externally provided to the axial end of the rotary shaft 41 in a detachable fashion, and is closed by each of inner and outer hatch members 8 and 9 having the following constitution.

That is, the inner hatch member 8 at an inner periphery side of the hearth 3, namely the left side of the FIG. 1, as shown in FIG. 3, is constituted by a flange member detachably fixed to a side wall of the insulating housing 2*a* for closing the through-hole 2*b*, a seal cover 81 integrally constructed by a cylindrical member externally fitted into the rotary shaft 41, and a seal flange 82 externally fitted to a side wall side of the inner bearing 5 or the outside of the seal cover 81 to be fixed to a cylindrical member and having a grease chamber 82*a* in the inner side for storing grease supplied from a grease feed pipe 82*b*.

Also, the outer hatch member 9 at an outer periphery side of the hearth 3, as shown in FIG. 4, is constituted by a flange member detachably fixed to the side wall of the insulating housing 2*a* for closing the through-hole 2*b*, a seal cover 91 integrally constructed by a cylindrical member externally fitted to the rotary shaft 41, and a seal flange 92 externally fitted to the outside of the seal cover 91 at a side wall side of the outer bearing 5' for being fixed to the cylindrical member and having a grease chamber 92*a* in the inner side for storing grease supplied from a grease feed pipe 92*b*. In other words, the outer hatch member 9 has the substantially same constitution as the inner hatch member 8. Further, the rotary hearth furnace 1 comprises an inner screw supporting device 10 and an outer screw supporting device 20 configured as follows, which are used when the reduced iron discharging screw 4 is detached from the furnace body 2 of the rotary hearth furnace 1 and when the reduced iron discharging screw 4, which is detached and repaired, is assembled to the furnace body 2.

The inner screw supporting device 10, as shown in FIGS. 1 and 3, is arranged at the outside of the inner periphery of the hearth 3. Also, the inner screw supporting device 10 is provided with a rod-shaped screw supporting metal member 11 which reciprocates as guided by a guide roller 14 adjustable in height installed over a frame at a certain interval and has the leading end being detachably connected to the leading end at an inner periphery side of the hearth 3 of the rotary shaft 41 through attachment/detachment of a bolt. The screw supporting metal member 11 is adapted to support the leading end of the reduced iron discharging screw 4 at the inner periphery side of the hearth 3 when the reduced iron discharging screw 4 is detached from the furnace body 2 and when the reduced iron discharging screw 4, which is detached and repaired, is assembled to the furnace body 2. Further, the inner screw supporting device 10 has an inner winch 12 as metal member dragging means for dragging the screw supporting Metal member 11 to be displaced outward of the inner periphery side of the hearth 3 by the winding of a metal member dragging rope 13.

In addition, within the screw supporting metal member 11 is installed a cooling water channel which has a constitution that cooling water is flown through the same to enable water cooling.

The outer screw supporting device 20, as shown in FIG. 1, is arranged at the outside of an outer periphery side of the hearth 3. Also, the outer screw supporting device 20 is provided with a screw supporting bogie 21 which reciprocates as guided by a guide rail 24 constructed over the frame and supports the leading end of the reduced iron discharging screw 4 at the inner periphery side of the hearth 3.

Further, the outer screw supporting device 20 has an outer winch 22 as a screw dragging means for dragging the reduced iron discharging screw 4 out of the outer periphery side of the hearth 3 so that the reduced iron discharging screw 4 can be removed from the furnace body 2 by the winding of a screw dragging rope 23.

As can be apparently understood from the foregoing description, according to the inner screw supporting device 10 and the outer screw supporting device 20, when the reduced iron discharging screw 4 is removed from the furnace body 2, the leading end of the screw supporting metal member 11 is connected to the leading end of the rotary shaft 41 of the reduced iron discharging screw 4 at the inner periphery side of the hearth 3. Also, the screw dragging rope 23 is connected to the leading end of the hearth 3 at the outer periphery side and wound through the operation of the outer winch 22 while a metal member dragging rope 13 is unwound from the inner winch 12 so that the reduced iron discharging screw 4 can be removed from the furnace body 2 outward of the outer periphery side of the hearth 3.

Meanwhile, on the contrary to the above, the metal member dragging rope 13 is wound through the operation of the inner winch 12 while the screw dragging rope 23 is unwound by the outer winch 22 so that the reduced iron discharging screw 4 can be displaced toward the inner periphery side of the hearth 3 to be assembled to the furnace body 2.

Then, referring to FIG. 1 and FIGS. 5 to 7, a detailed constitution of the reduced iron discharging screw 4 will be described. A swivel joint 4*a* configured as an elbow is provided to the leading end of the rotary shaft 41 of the reduced iron discharging screw 4 at the outer periphery side of the hearth 3, and a cooling water channel 41*a* (refer to FIG. 5) defined within the rotary shaft 41 is supplied with cooling water from a cooling water introducing pipe 4*b* connected to the swivel joint 4*a*. Of course, cooling water heated through cooling the rotary shaft 41 of the reduced iron discharging screw 4 is drained via a cooling water drain pipe 4*c* connected to the swivel joint 4*a*.

Further, at the outer periphery of the rotary shaft 41 of the reduced iron discharging screw 4, is formed a refractory layer 43 as shown in FIG. 5. The refractory layer 43 is formed on the outer periphery of the rotary shaft 41 like this for the purpose of preventing the contact of corrosive gas to the outer periphery of the rotary shaft 41 to prevent corrosion of the rotary shaft 41. In this case, the temperature of the refractory layer 43 is maintained higher than that of the outer periphery of the rotary shaft 41, which is successively water-cooled, resultantly having an effect of resting cohesion of corrosive gas.

Further, at the leading end of the spiral blade 42 of the reduced iron discharging screw 4 is installed an elongated groove 45 thinner than the thickness width of the spiral blade 42. The elongated groove 45 is filled with a hard facing layer 46. A hard facing material adopted in the hard facing layer 46 employs a Fe-based material which is a eutectic of chronium carbide into austenitic stainless steel This can prevent deficiency of a hard facing portion caused by a welding defect such as an undercut created between a base metal and the hard facing portions at sides of the leading end of the screw blade as in the screw blade according to the prior art in which the leading end and the both sides are covered by the hard facing layer.

Again, since the hard facing layer is not formed at the sides of the leading end of the spiral blade 42 according to the embodiment of the invention, it can be considered that the sides of the leading end of the spiral blade 42 may be worn in an early stage. However, according to experiences of the inventors, it has been observed that the sides of the leading end are not heavily worn even if the leading end of the spiral blade 42 is heavily worn. So, this can be understood that the leading end and the both sides thereof of the screw blade according to the prior art are covered with the hard facing layer, nevertheless, since the hard facing layer tends to be peeled off from the leading end due to a shearing force created during rotation when the hard facing layer is formed only at the leading end.

Further, in the reduced iron discharging screw 4, the spiral blade has threads in a greater number at the outer periphery side of the hearth 3 or at the side of the discharge port 3*a* than at the inner periphery side of the hearth 3.

More particularly, as shown in FIG. 7, in the outer periphery of the reduced iron discharging screw 4 at the discharge port 3*a* side of the rotary shaft 41 and between spiral pitches of the spiral blade 42, an intermediate spiral blade 44 (a portion with the whole section being printed in FIG. 7) is provided with a length of ⅓ of the whole length of the spiral blade 42. Of course, at the leading end of the intermediate spiral blade 44, as in the spiral blade 42, is installed an elongated groove thinner than the thickness width of the intermediate spiral blade 44, which is filled with a hard facing layer. The reduced iron discharging screw 4 is configured as above for the purpose that reduced iron on the hearth 3 can be moved in a direction to the discharge port 31*a* without escaping from the spiral blade as well as the reduced iron discharging screw 4 is rotated in low speed to reduce abrasion of the spiral blade 42 and the intermediate spiral blade 44.

As well known, as the hearth 3 has a rotational speed increasing as advancing radially outward, the hearth 3 is relatively faster than the spiral blade 42 when contacting the spiral blade 42. Further, in order to reliably displace reduced iron toward the discharge port 3*a* while preventing reduced iron from escaping from the spiral blade when reduced iron on the upper surface of the hearth 3 is discharged out of the furnace body 2, it is necessary to rotate the reduced iron discharging screw 4 at a rotational speed sufficient to capture reduced iron moving in the highest speed or positioned on the outermost outer periphery of the hearth 3. Therefore, the reduced iron discharging screw 4 is rotated in high speed so that the spiral blade 42 is worn in a short time period and thus the reduced iron discharging screw 4 is necessarily short lived. Therefore, the intermediate spiral blade 44 is installed to prevent reduced iron from escaping even the reduced iron discharging screw 4 is rotated in a low rotational speed while reliably displacing reduced iron toward the discharge port 3*a* as well as enabling the lifetime of the spiral blade to be prolonged.

In this case, while the length of the intermediate spiral blade 44 is set ⅓ of the whole length of the spiral blade 42 as above, the length of the intermediate spiral blade 44 is not limited to ⅓ of the whole length of the spiral blade 42 but can be suitably determined according to a relative speed of the spiral blade and the surface of the hearth 3. Moreover, even if it is so configured that the whole length of the intermediate spiral blade 44 is the same as that of the spiral blade 42 and the intermediate spiral blade 44 is placed between the whole spiral pitches of the spiral blade 42, the same effect of reducing abrasion of the spiral blade can be obtained as in the reduced iron discharging screw 4 having the foregoing constitution. However, it is not preferable in the manufacturing cost of the reduced iron discharging screw 4 since the intermediate spiral blade 44 is arranged excessively even though the rotational speed at the inner periphery side of the hearth 3 is lower than at the outer periphery side and the spiral blade itself serves sufficiently.

Hereinafter, description will be made about an operational aspect of the rotary hearth furnace 1 and the reduced iron discharging screw 4 configured as above. First, describing the operational aspect of the rotary hearth furnace 1, the reduced iron discharging screw 4 is rotated via a chain sprocket 41*d* from a driving unit 1*a* installed on the furnace body 2 together with the hearth 3 through the operation of the rotary hearth furnace 1.

The reduced iron discharging screw 4 is gradually worn out through continued rotation and when the reduced iron discharging screw 4 is removed from the insulating housing 2*a* of the furnace body 2 for repair when the amount of wear reaches a preset standard value, however, a preparatory operation is performed to remove the reduced iron discharging screw 4 before a removal operation.

The grease feed pipe 51 is detached from the inner bearing 5 supporting the end of the reduced iron discharging screw 4 at the inner periphery side of the hearth 3 and the grease feed pipe 82*b* is detached from the seal flange 82 of the inner hatch member 8. Then, an end plate 41*b* for determining a longitudinal position of the reduced iron discharging screw 4, a spacer 41*c* and the inner bearing 5 detached from the inner supporting device 7 are detached from the end of the rotary shaft 41 of the reduced iron discharging screw 4 at the inner periphery side of the hearth 3 while the inner hatch member 8 constituted by the seal cover 81 and the seal flange 82 is detached from the insulating housing 2*a*, so that the end of the rotary shaft 41 at the inner periphery side of the hearth 3 becomes free.

Then, a screw hole where the end plate 41*b* was attached is utilized to connect the leading end of the screw supporting metal member 11 of the inner screw supporting device 10 to the end of the rotary shaft 41 at the inner periphery side of the hearth 3 so that the end of the rotary shaft 41 at the inner periphery side is maintained at a certain height by the guide rollers 14, 14 as well as the cooling water feed and cooling water drain pipes not shown are connected to the screw supporting metal member 11.

Then, the grease feed pipe 51 is detached from the outer bearing 5' supporting the end of the reduced iron discharging screw 4 at the outer periphery side of the hearth 3, the grease feed pipe 92*b* is detached from the seal flange 92 of the outer hatch member 9, and then the outer bearing 5' is detached from the outer supporting device 7'. Further, the outer hatch member 9 constituted by the seal cover 91 and the seal flange 92 is detached from the insulating housing 2*a* and a chain is detached from the sprocket 41*d* to set free the end of the rotary shaft 41 at the outer periphery side of the hearth 3. Then, the preparatory operation for removing the reduced iron discharging screw 4 from the furnace body 2 is completed. The inner hatch member 8 and the outer hatch member 9 are removed in such a preparatory operation so that the reduced iron discharging screw 4 can be removed via the through-holes 2*b*, 2*b*.

When such a preparatory operation is completed, an operation is performed for removing the reduced iron discharging screw 4 from the furnace body 2. In other words, the screw dragging rope 23 is wound using the outer winch 22 of the outer screw supporting device 20 while the free end of the rotary shaft 41 at the outer periphery side of the hearth 3 is supported as suspended via a wire rope not shown using a hook F to remove the reduced iron discharging screw 4 via the through-holes 2*b* of the insulating housing 2*a*. Then, the removed reduced iron discharging screw 4 is loaded on the screw supporting bogie 21, which is displaced to a certain repairing site on the frame of the outer screw supporting device 20 thereby to finish the operation of removing the reduced iron discharging screw 4. In addition, when the reduced iron discharging screw 4 is removed from the furnace body 2, a simple insulation operation is preferably performed to protect the reduced iron discharging screw 4 in order to reduce damage of the reduced iron discharging screw 4 in passing through the furnace body 2.

Then, the reduced iron discharging screw 4 is repaired, and then the metal member dragging rope 13, which was unwound in removing the reduced iron discharging screw 4, is wound using the inner winch 12 of the inner screw supporting device 10 to assemble the reduced iron discharging screw 4 via the through-holes 2*b* of the insulating housing 2*a*. Portions of the components at the outer periphery side of the hearth 3 and the components at the inner periphery side of the hearth 3 are attached to corresponding sites according to a sequence reverse to the above.

Then, after the screw supporting metal member 11 is detached from the end of the rotary shaft 41 at the inner periphery side of the hearth 3 and the metal member dragging rope 13 is wound again by the inner winch 12 to retract the screw supporting metal member 11 in a direction facing away from the end of the rotary shaft 41 at the inner periphery of the hearth 3, the end plate 41*b*, the spacer 41*c* and the inner bearing 5 are attached while the grease feed pipe 51 and the grease feed pipe 82*b* are respectively attached to the inner bearing 5 and the seal flange 82 of the inner hatch member 8 to finish an operation of recovery.

Therefore, according to the rotary hearth furnace 1 related to the present embodiment, it is not necessary to detach a portion of furnace body cover corresponding to the projected area of the reduced iron discharging screw as in the prior art, and the opening area of the through-holes 2*b*, 2*b* is smaller than the projected area of the reduced iron discharging screw, so that a large scale of radiation scheme is not necessary. Further, in regard to layout of the equipments, even if the equipments such as the staple pins are arranged at the upper position, the reduced iron discharging screw 4 is removed and assembled in a lateral direction so that the reduced iron discharging screw 4 can be detached/assembled from/to the furnace body 2 in a time period much more shorter and with endeavors less than in the prior art. Thus, there is a remarkable effect that the maintenance cost of the reduced iron discharging screw 4 can be reduced Hereinafter, description will be made about an operational aspect of the reduced iron discharging screw 4 of the rotary hearth furnace according to this embodiment. In the reduced iron discharging screw 4, at the outer periphery of the rotary shaft 41 is formed the refractory layer 43 which is continuously maintained at a temperature higher than that of the outer periphery of the rotary shaft 41 which is continuously water cooled in the operation. Then, in addition that cohesion of corrosive gas is restricted, contact of corrosive gas to the outer periphery of the rotary shaft 41 is prevented even if corrosive gas is cohered so that corrosion of the rotary shaft 41 is effectively restricted.

Further, the elongated groove 45 installed in the leading end of the spiral blade 42 of the reduced iron discharging screw 4 is filled with the hard facing layer 46 to avoid the welding defect such as the undercut between the base metal and the hard facing portion at the sides of the leading end of the screw blade as in the screw blade in the prior art in which the leading end and the both sides are covered by the hard facing layer thereby preventing loss of the spiral blade due to the welding defect.

Further, the intermediate spiral blade 44 is circumferentially provided with the length of ⅓ of that of the spiral blade 42 at the outer periphery at the discharge port side 3*a* of the rotary shaft 41 of the reduced iron discharging screw 4 and between the spiral pitches of the spiral blade 42 so that reduced iron on the hearth 3 can be displaced toward the discharge port 3*a* without escaping from the spiral blade 42 and the reduced iron discharging screw 4 can be rotated in a low speed. Accordingly, the spiral blade 42 and the intermediate spiral blade 44 have the reduced amount of abrasion so that the lifetime of the spiral blade 42 and the intermediate spiral blade 44 are prolonged in a great amount compared to those in the prior art. Also, since the bearing externally fitted to the reduced iron discharging screw 4 is supported via the buffer member 6, even if the distance between the shaft center of the reduced iron discharging screw 4 and the surface of the hearth 3 is changed slightly, the contact pressure of the leading end of the spiral blade 42 of the reduced iron discharging screw 4 to the surface of the hearth 3 can be maintained at or under a certain contact pressure thereby serving to restrict abrasion of the spiral blade by a large margin.

Therefore, according to the reduced iron discharging screw 4 of the rotary hearth furnace related to the embodiment of the present invention, the refractory layer 43 is formed at the outer periphery to prevent corrosion of the rotary shaft 41 caused by corrosion gas, the hard facing layer 46 is filled in the elongated groove 45 installed in the leading end of the spiral blade 42 to prevent damage, the intermediate spiral blade 44 is arranged at the outer periphery at the discharge port side 3*a* of the rotary shaft 41 and between the spiral pitches of the spiral blade 42 to reduce the rotation number and thus restrict abrasion of the spiral blade, and the buffer member 6 supports the leading end of the spiral blade 42 to prevent increase of the contact pressure to the hearth 3 surface. These incur a synergy effect that the lifetime of the reduced iron discharging screw 4 is prolonged in a greater amount than in the prior art and the frequency of repairing the reduced iron discharging screw 4 is decreased. As a result, remarkably excellent effects can be obtained that the operating ratio of the rotary hearth furnace 1 can be enhanced by a large margin and the cost of reduced iron can be reduced in a great amount. Moreover, the lifetime of the reduced iron discharging screw 4 can be prolonged when only one of the foregoing means is implemented.

As described above, in the rotary hearth furnace according to the claim 1 of the present invention, the inner hatch member and the outer hatch member are attached/detached and the reduced iron discharging screw is supported using the inner screw supporting device and the outer screw supporting device so that the reduced iron discharging screw can be laterally removed from the furnace body via the through-holes and laterally assembled to the furnace body via the through-holes on the contrary.

Therefore, in the rotary hearth furnace according to the present embodiment, it is not necessary to detach the furnace body cover as wide as at least the projected area of the reduced iron discharging screw, the radiation scheme in a large scale is not necessary due to small opening area of the through holes, and the reduced iron discharging screw is removed laterally as above even if the equipments such as the staple pins are arranged in regard to layout of the equipments so that the reduced iron discharging screw can be detached in a much shorter time period than in the prior art regardless of the arrangement between the equipments. Accordingly, the maintenance cost of the reduced iron discharging screw can be reduced in a great amount.

In the reduced iron discharging screw of the rotary hearth furnace according to the $2^{nd}$ aspect of the present invention, the refractory layer is formed at the outer periphery of the rotary shaft of the reduced iron discharging screw, in which the temperature of the refractory layer is continuously maintained higher than that of the outer periphery of the rotary shaft which is continuously water cooled during the operation. Accordingly, cohesion of corrosive gas is restricted and the contact of corrosive gas to the outer periphery of the rotary shaft is prevented even if corrosive gas is cohered to restrict corrosion of the rotary shaft thereby enabling the lifetime of the rotary shaft to be prolonged in a great amount.

In the reduced iron discharging screw of the rotary hearth furnace according to the $3^{rd}$ aspect of the present invention, the elongated groove installed in the leading end of the spiral blade of the reduced iron discharging screw 4 is filled with the hard facing layer so that the welding defect such as the undercut may not occur between the base metal and the hard facing portion at the sides of the leading end of the screw blade unlike the screw blade of the prior art, in which the leading end and the both sides are covered with the hard facing layer, thereby preventing damage of the spiral blade caused by the welding defect.

In the reduced iron discharging screw of the rotary hearth furnace according to the $4^{th}$ aspect of the present invention, the spiral blade has more threads at the outer periphery side of the hearth than at the inner periphery of the hearth so that reduced iron which is being displaced in high speed can be displaced toward the discharge port without escaping from the spiral blade and the reduced iron discharging screw can be rotated in low speed to reduce abrasion of the spiral blade thereby prolonging the lifetime of the spiral blade in a greater amount compared to the prior art.

In the reduced iron discharging screw of the rotary hearth furnace according to whe $5^{th}$ aspect of the present invention, the reduced iron discharging screw is supported via the buffer member. Then, even if the distance between the shaft center of the reduced iron discharging screw and the surface of the hearth is changed slightly, the contact pressure of the leading end of the spiral blade of the reduced iron discharging screw to the surface of the hearth is maintained at or under a certain contact pressure thereby serving in a great amount to restrict abrasion of the spiral blade.

In the reduced iron discharging screw of the rotary hearth furnace according to any of the $2^{nd}$–$5^{th}$ aspects of the present invention, the refractory layer is formed at the outer periphery to prevent corrosion caused by corrosion gas, the elongate groove of the leading end of the spiral blade is filled in the hard facing layer, the spiral blade has more threads at the discharge port side to reduce the rotation number thereby restricting abrasion of the spiral blade, and the buffer member prevents increase of the contact pressure of the leading end of the spiral blade to the hearth surface. Then, a synergy effect is incurred that the lifetime of the reduced iron discharging screw is prolonged in a great amount, the maintenance frequency of the reduced iron discharging screw is reduced to enhance the operating ratio of the rotary hearth furnace in a great amount, and the cost of reduced iron can be saved.

What is claimed is:

1. A rotary hearth furnace comprising:

a furnace body having a hearth and inner and outer side walls, each including through holes;

a reduced iron discharging screw having a rotary shaft and a spiral blade dimensioned to pass through said through holes, said reduced iron discharging screw being mounted in said furnace body at a location to discharge reduced iron on the hearth from a discharge port of the furnace body, wherein axial ends of said rotary shaft extend through said through holes to the exterior of said furnace body;

hatch members removably mounted to said axial ends of said rotary shaft, said hatch members externally closing said through holes;

a first supporting device comprising means for removing said reduced iron discharging screw from said furnace body via one of said through holes at one of said side walls, and a movable bogie positionable to support the removed reduced iron discharging screw; and a second screw supporting device comprising a reciprocatable member having an end detachably connectable at the other of said side walls, and means for moving the reciprocatable member so as to draw the reduced iron discharging screw out of said furnace body.

* * * * *

UNITED STATES PATENT AND TRADEMARK OFFICE

CERTIFICATE OF CORRECTION

PATENT NO. : 6,814,924 B2
DATED : November 9, 2004
INVENTOR(S) : Urabe et al.

It is certified that error appears in the above-identified patent and that said Letters Patent is hereby corrected as shown below:

Title page,
Item [73], should read as follows:
-- [73] Assignee: Kabushiki Kaisha Kobe Seiko Sho (Kobe Steel, Ltd.) Kobe (JP) --
Items [45] and [*] Notice, should read as follows:
-- [45] **Date of Patent: *Nov. 9, 2004**
[*] Notice: Subject to any disclaimer, the term of this patent is extended or adjusted under 35 U.S.C. 154(b) by 19 days.

This Patent is subject to a terminal disclaimer. --

Signed and Sealed this

Fifteenth Day of February, 2005

JON W. DUDAS
*Director of the United States Patent and Trademark Office*